US009375067B2

(12) United States Patent
Inukai

(10) Patent No.: US 9,375,067 B2
(45) Date of Patent: Jun. 28, 2016

(54) GUEST CHECK PRESENTER DEVICE AND METHOD OF USE

(71) Applicant: Connie B. Inukai, Gaithersburg, MD (US)

(72) Inventor: Connie B. Inukai, Gaithersburg, MD (US)

( * ) Notice: Subject to any disclaimer, the term of this patent is extended or adjusted under 35 U.S.C. 154(b) by 41 days.

(21) Appl. No.: 13/935,498

(22) Filed: Jul. 4, 2013

(65) Prior Publication Data

US 2014/0164152 A1 Jun. 12, 2014

Related U.S. Application Data

(60) Provisional application No. 61/668,089, filed on Jul. 5, 2012, provisional application No. 61/749,938, filed on Jan. 8, 2013.

(51) Int. Cl.

| | |
|---|---|
| ***G06Q 30/00*** | (2012.01) |
| ***A45C 15/02*** | (2006.01) |
| ***G06G 1/14*** | (2006.01) |
| ***G06Q 50/12*** | (2012.01) |
| ***A45C 15/06*** | (2006.01) |
| ***B42F 7/06*** | (2006.01) |
| ***G07F 7/00*** | (2006.01) |
| ***A45C 11/18*** | (2006.01) |

(52) U.S. Cl.

CPC ..... *A45C 15/02* (2013.01); *A45C 11/18* (2013.01); *A45C 15/06* (2013.01); *B42F 7/06* (2013.01); *G06G 1/14* (2013.01); *G06Q 50/12* (2013.01); *G07F 7/005* (2013.01); *A45C 11/182* (2013.01)

(58) Field of Classification Search

CPC ..... G06Q 50/12; G06G 1/14

USPC ..... 705/15; 362/98; 206/232; 708/134, 144; 345/169; 235/61 R, 58 M

See application file for complete search history.

(56) References Cited

U.S. PATENT DOCUMENTS

| | | | | |
|---|---|---|---|---|
| 2002/0163504 | A1* | 11/2002 | Pallakoff | 345/169 |
| 2003/0005004 | A1* | 1/2003 | Soliman | 708/134 |
| 2004/0099546 | A1* | 5/2004 | Schlosser | 206/232 |
| 2007/0115650 | A1* | 5/2007 | Cohan et al. | 362/99 |
| 2013/0212137 | A1* | 8/2013 | Guillaud et al. | 708/144 |

FOREIGN PATENT DOCUMENTS

| | | | | |
|---|---|---|---|---|
| TW | M416145 U1 * | 11/2011 | | G06F 7/38 |

* cited by examiner

*Primary Examiner* — Hunter Wilder
(74) *Attorney, Agent, or Firm* — Richard Mark Blank, Esq.

(57) ABSTRACT

A Guest Check Presenter Device and Method of Use. In one embodiment, advantageous for establishment use, the invention comprises a guest check presenter in the form of a booklet having a bill slot for holding a bill which can be made of transparent magnifying plastic that enlarges the appearance of the bill, which can be coupled with a light, enhancing visibility of the bill. The system also provides for a calculation device that limits its functionality and options: permitting the patrons to split the total of the bill, and calculate the percentage of gratuity desired selecting from choices provided on the face of the device. In a second embodiment advantageous for personal use, the case has a front and back side, with a computation device, a magnifier, and a light all being disposed on the case. By offering only limited functions, the device is made more user-friendly and time-efficient. The invention aids the elderly and eyesight-impaired individuals.

3 Claims, 21 Drawing Sheets

Power Off

GUEST CHECK PRESENTER DEVICE AND METHOD OF USE

This application claims the benefit under 35 U.S.C 119 (e) of any U.S. provisional application(s) listed below:

Application No. 61/668,089, having a filing date of Jul. 5, 2012; and

Application No. 61/749,938, having a filing date of Jan. 8, 2013.

FIELD OF THE INVENTION

The present invention relates to a device and method for presentation of a restaurant bill to patrons. More specifically, the invention relates to specialty calculation device and such calculation device incorporated into novel guest check presenter. In one embodiment which is advantageous for presentation of a restaurant bill to patrons, the guest check presenter of the invention includes an integrated specialty calculation device, a back light, transparent magnifying bill sleeve, and card pocket. The present invention also incorporates a unique accompanying method of operation and presentation to be used in conjunction with each device. In a second embodiment advantageous for personal patron use, the case has a front and back side, with a computation device, a magnifier, and a light all being disposed on the case. By offering the user(s) only limited functions, the device is made more user-friendly and time-efficient. The invention aids the elderly and eyesight-impaired individuals. Together the unique devices and methods of operation benefit patrons and restaurant owners.

BACKGROUND OF THE INVENTION

It is customary within the restaurant industry for a bill to be presented to patrons in the form of a booklet. The traditional guest check presenter may be opened and closed like a booklet and often contains sleeves or pockets on the inside walls to hold credit cards, dining bills, pens, and cash. While this traditional style is still commonly used, advancements in technology have brought some modifications to the traditional guest check presenter. These modifications aim to increase the satisfaction of the customer experience by reducing inconveniences such as inadequate bill visibility and the difficulties of computing mathematical equations during check presentation. By eliminating these inconveniences and difficulties, which cause the customer to feel uncomfortable, embarrassed, or bothered, the present invention enhances the customer experience. It also expedites the process and therefore benefits the restaurant by increasing the turnaround rate of tables.

In an effort to surmount the aforementioned issues, prior devices have been developed incorporating modern technologies such as back lights, magnifying planes, and calculators into guest check presenters. However, this prior art does not satisfy the demand for producing a product which incorporates the aforementioned features into a traditional guest check presenter, while maintaining a simplistic design that i) is cost efficient for the establishment; ii) employs an easily operable user interface; and iii) utilizes a unique method of operation that promotes expedited transactions while minimizing customer computation error. All of these impairments are resolved by the present invention.

By offering only limited easy to use functions, the device is made more user-friendly and time-efficient. This invention aids the elderly and eyesight-impaired individuals.

SUMMARY OF INVENTION

It is the primary object of the present invention to provide guest check presenters with an incorporated specialty device offering the user specific and limited computing, to compute tip and split the bill among the party, and the invention provides specialty computation devices to perform the same. The specialty computation devices are uniquely designed to maximize the ease of gratuity calculations and divide the bill amongst multiple parties while diminishing the chance of customer computation error and minimizing customer data input.

It is a further object of the present invention to provide an option for a light, or back light, and a magnifier. As a result of subdued lighting conditions, poor customer eyesight, or undersized fonts and bill prints, customers often have inadequate bill visibility. The present invention incorporates a back light and sleeve magnifier to address and remedy these issues and ultimately create a positive customer experience.

It is another object of the present invention to incorporate a payment card pocket for the placement and securing of the patron's payment credit card.

It is a further object of the present invention to provide the guest check presenter with the aforementioned features incorporated in an economically efficient alternative compared to those currently available on the market. The present invention accomplishes this objective by eliminating superfluous construction materials and by employing a simplistic yet innovative design. The present invention does not incorporate materials unnecessary to the achievement of its purpose.

Unlike the prior art, the computation device of the first embodiment of the present invention is not a generic calculator, nor does it include buttons to perform arithmetic equations outside the scope of computing gratuity percentages and party divisions, thus avoiding user confusion and avoiding user technical difficulties. This conservative design enables a reduction in materials needed for the unit's construction, thus providing a more economically efficient product.

Furthermore, the check presenter of the embodiments of the present invention does not incorporate an additional element into its design by including a separate magnifying plane. In accordance with the first embodiment, the invention deducts an element from its construction by constructing the bill sleeve out of a transparent magnifying plastic. This further simplifies use, reduces user steps, and reduces costs.

Unlike the prior art, the computation device of the second embodiment of the invention has the ability to transition between different modes or states of operation so that the same number keys can be used to calculate the tip and the amount owed by each party splitting the bill. This conservative design enables a reduction in materials needed for the unit's construction, thus providing a more economically efficient product. Furthermore, the check presenter of the second embodiment of the present invention does not incorporate an additional element into its design by including a separate magnifying plane, but rather deducts an element from its construction by including a magnifier in a single plane along with the specialty computation device. This further simplifies use, reduces user steps, and reduces costs.

It is a further object of the present invention to provide a method of operation that would expedite gratuity and divided-party bill computations while also minimizing customer computation error. The method directs the server to enter the bill amount into the guest check presenter computation device before presenting it to the customer, although the customer could also enter the bill amount. This step decreases customer computation time, and increases both efficiency and accuracy, in that the user does not need to take the time to input the total bill amount and, thus, does not risk making a mistake in the amount during the input process. This especially aids elderly, eyesight-impaired, and mathematically challenged individuals. Also, in the first embodiment, by requiring the user to only glance at the total and press a simple percentage button to calculate the gratuity, this again especially aids elderly, eyesight-impaired, and mathematically challenged individuals.

The present invention has several advantages and important unique features that address the aforementioned industry needs. The present invention's innovative and conservative design makes it a more cost-efficient product than what is currently available. In one embodiment of the present invention user error is mitigated by incorporating a unique and novel computation device with buttons that are solely task-specific. All embodiments of the invention remove buttons for unnecessary arithmetic equations outside the scope of the unit's intended purpose, so that the unit is made more user-friendly and time efficient. Also, this invention significantly aids the elderly and eyesight-impaired individuals. This clientele generally does not use cell phone apps in restaurants. The party check-splitting feature also simplifies the process, reduces error, and improves the experience.

DETAILED DESCRIPTION OF THE INVENTION

Figure 1:
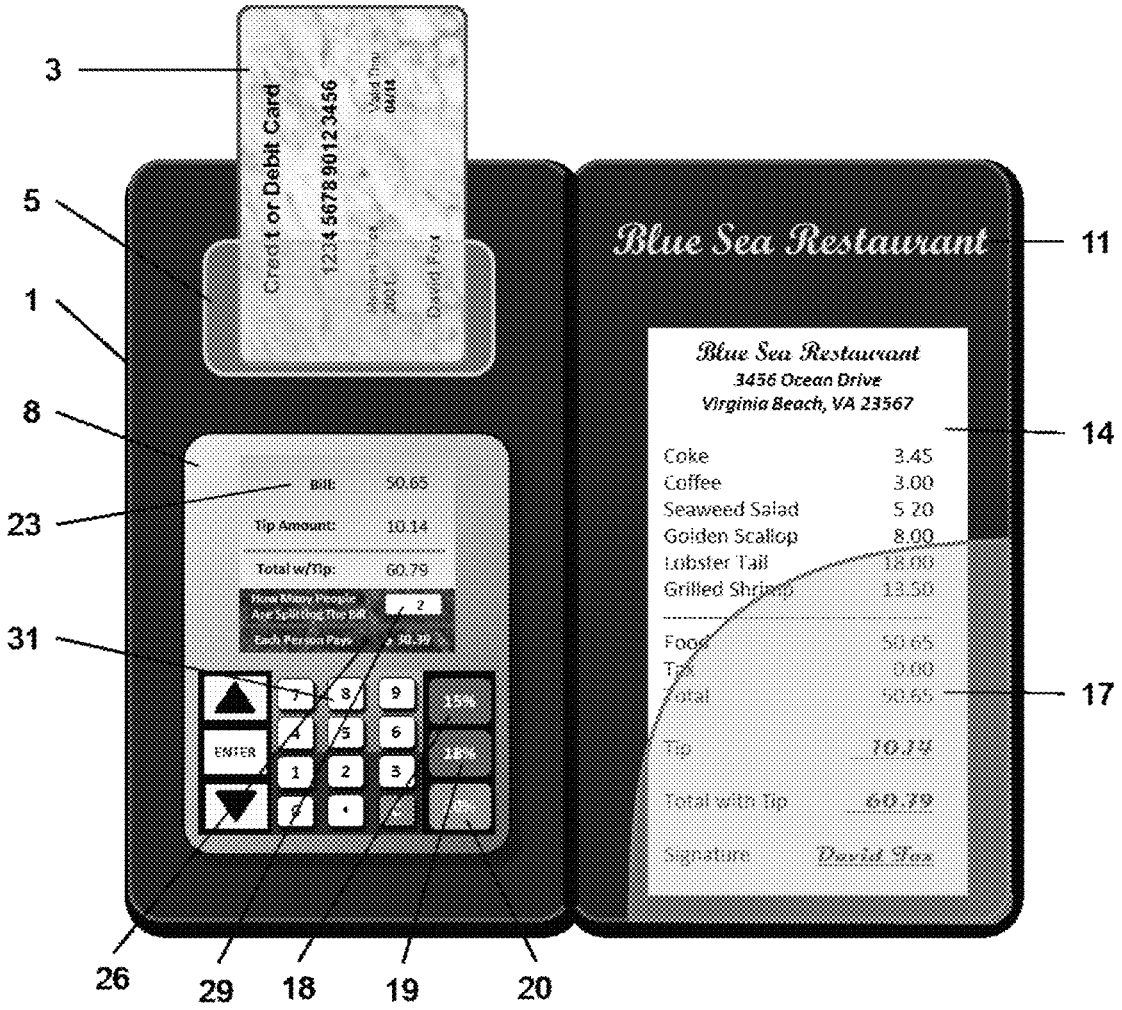
FIG. 1 is a front view of a guest check presenter of the first embodiment showing the design in an open position and demonstrating where a credit card can be inserted in the guest check presenter.
Figure 2:
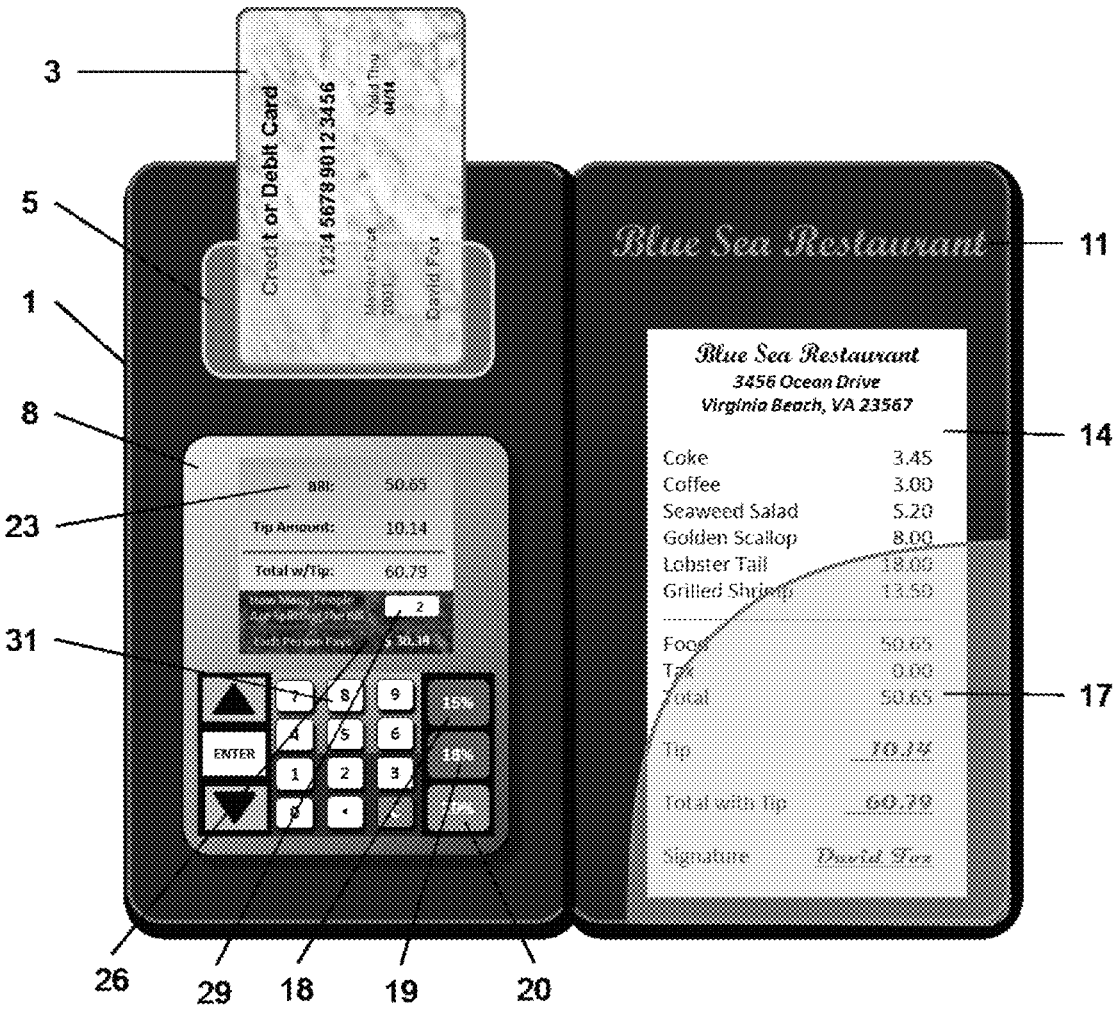
FIG. 2 is the same image as that of FIG. 1, rendered in black and white.

The present invention incorporates aspects and features of modern technological modifications, commonly found in traditional guest check presenters, in a novel and significant fashion. A guest check presenter according to the first embodiment is a small, flat booklet with a top and bottom cover, each including an inner face and connected together by a common binding that can be opened and closed. A guest check refers to a form used in a food service establishment to record customer orders and present it afterwards for payment. The present invention incorporates a novel and innovative arrangement of uniquely designed features into a traditional guest check presenter in order to enhance customer experience, facilitate expedited bill transactions, and satisfy current market demand for a cost-efficient, technologically-savvy guest check presenter that reduces customer error. The features may include: a transparent magnifying bill sleeve, a light, or back light, a specialty gratuity and split-bill-by-party computation device, and at least one credit card pocket.

The invention of the first embodiment enhances a customer guest check presentation experience in a multitude of ways. The first of these ways is to increase bill visibility. The invention has several features which may be included for the purpose of increased bill visibility. The first of these inventive features is a transparent magnifying bill sleeve. This feature is aimed to help customers with poor eyesight. The transparent bill sleeve is comprised of a transparent magnifying plastic bill sleeve that enlarges the appearance of the bill for the convenience of the customer. Rather than having to reach for their glasses, near-sighted customers can enjoy the convenience of a magnified, and thus more readable, bill.

The second of these inventive features is a light feature. Incorporated into the guest check presenter design is a light to illuminate the bill. The light can be located anywhere on the guest check presenter. The figures show an example where the light is a back light and located inside the guest check presenter. This feature is particularly helpful in venues with mood lighting, where subdued lighting makes it difficult to clearly identify the markings on the bill. The light can use any type of light source to illuminate the bill. In one embodiment of the invention, an LED is used as the back light. The light can have its own means for turning the light on or off, or this means can be shared with the calculating device to also turn it on or off. Non-limiting examples of such means include a light activated switch which is turned on when the guest check presenter is opened, an on/off button, or a sliding on/off switch. The calculating device on/off switch may also enable or disable lighting of all keys.

Another way the present invention enhances the customer experience is by minimizing customer computation error and simplifying gratuity and split-party calculations. Unique aspects of both the computation device and the device's method of operation are designed to accomplish this task. This is especially helpful for elderly customers who typically do not use cell phone apps. To minimize customer computation error, the invention employs a method in which the server enters the bill amount into the specialty computation device within the guest check presenter before presenting the guest check to the patron, consequently minimizing customer data input. In addition, the specialty computation device is designed in a manner to only perform task-specific calculations. These calculations are limited to gratuity computations and bill divisibility computations. To aid in the object of minimizing customer data input and therefore computation error, the only buttons incorporated into the unit's design are those which are task-specific, purposely restricting a user's ability to enter incorrect arithmetic calculations. The first embodiment of the specialty device comprises:

i. 0-9 numerical buttons, including a decimal point button, for the server to enter the total bill amount (the buttons are real and/or virtual);

ii. one or more viewing screens;

iii. pre-programmed gratuity percentage buttons in the amounts of 15%, 18%, and 20%, although other percentages could of course be used;

iv. incremental buttons with an up-and-down arrow for the user to raise or lower the percentages; and v. pre-programmed split-party buttons to divide the bill accordingly amongst the parties.

The present invention also employs a unique design specifically intended to create a cost-efficient product to meet market demand. Current guest check presenters on the market that employ similar features are not cost-efficient for restaurant owners. These products are expensive and consequently deter restaurants from providing customers with such a product. It is a primary objective of the present invention to provide a design that changes this. The present invention accomplishes this by a careful and conservative selection of construction materials in accordance with an innovative design. This is accomplished by cutting out superfluous features. The specialty calculators do not include plus, minus, multiplication, or division buttons in their design. The present invention recognizes that these buttons would be unnecessary to the intended function of the device, and therefore the present invention is designed accordingly. Similarly, in the first embodiment, the magnifying plane on the unit is incorporated as the bill sleeve, rather than a standalone magnifying plane. These adaptations to the common design are important because they allow a decreased manufacturing cost, which will ultimately make the product more cost-efficient, enabling more restaurants to purchase a technologically advanced guest check presenter.

According to the first embodiment, the guest check presenter comprises:

a. credit card pocket;

b. a computation device designed to output gratuity percentages and split the bill total among multi-person parties; the computation device having a keypad;

c. a transparent magnifying bill sleeve; and d. a back light.

Also according to the first embodiment, the guest check presenter may comprise:

a. a front cover and a back cover, said front and back covers each including an inner face, and said front and back covers being hinged together along a common binding for allowing movement of said front and back covers between an open position, wherein said inner faces of said front and back covers are visibly exposed, and a closed position wherein said front cover is positioned in overlying relation to said back cover;

b. at least one credit card pocket disposed on the inner face of the front cover and/or the back cover;

c. a computation device removably attached to the inner face of the front cover and/or the back cover, the computation device having a means for computing a gratuity percentage of a guest check and having a means for splitting the guest check total among multi-person parties;

d. a transparent magnifying sleeve for the guest check disposed on the inner face of the front cover and/or the back cover; and e. a light disposed on the inner face of the cover having the magnifying sleeve. More specifically, the light can be a backlight.

A guest check presenter according to the second embodiment is a one-piece unit. It can be small enough to fit in a person's hand or pocket. This invention incorporates a novel and innovative arrangement of uniquely designed features into a guest check presenter in order to enhance customer experience, facilitate expedited bill transactions, and satisfy current market demand for a cost-efficient, technologically-savvy guest check presenter that reduces customer error. The features may include: a transparent magnifying section, a light, or back light, a specialty gratuity and split-bill-by-party computation device, and at least one holder or pocket for the bill and/or a credit card. This holder or pocket is not shown in the figures but can be located anywhere in or on the guest check presenter. The one-piece unit can have a slit in it forming a pocket for a bill and/or credit card. An outside pocket for a bill and/or credit card can be formed on the one-piece unit on either the front or the back thereof. A clip can be included to hold a bill and/or credit card to the guest check presenter. The design shown in FIGS. 20 and 21 make it easy to add a pocket to the back of the unit, opposite the computation device on the front.

The guest check presenter according to the second embodiment is a one-piece unit may consist of a calculating device, a magnifier, an LED backlight, and a sliding on/off switch for the light. It may include a pocket-sized lighted magnifier, the calculating device functions, the transition stages, and displays of the various states.

This invention of the second embodiment enhances a customer guest check presentation experience in a multitude of ways. The first of these ways is to increase bill visibility. The invention has several features which may be included for the purpose of increased bill visibility. The first of these inventive features is a transparent magnifying bill section. This feature is aimed to help customers with poor eyesight. The transparent magnifying bill section enlarges the appearance of the bill for the convenience of the customer. Rather than having to reach for their glasses, near-sighted customers can enjoy the convenience of a magnified, and thus more readable, bill.

The second of these inventive features is a light feature. Incorporated into the guest check presenter design is a light to illuminate the bill. The light can be located anywhere on the guest check presenter. The figures show an example where the light is a back light and located on the back of the guest check presenter. This feature is particularly helpful in venues with mood lighting, where subdued lighting makes it difficult to clearly identify the markings on the bill. The light can use any type of light source to illuminate the bill. In one example of the invention, an LED is used as the light. The light can have its own means for turning the light on or off, or this means can be shared with the calculating device to also turn it on or off. Non-limiting examples of such means include a light activated switch which is turned on when the guest check presenter is opened, an on/off button, or a sliding on/off switch.

Another way the present invention enhances the customer experience is by minimizing customer computation error and simplifying gratuity and split-party calculations. Unique aspects of both the computation device and the device's method of operation are designed to accomplish this task.

This is especially helpful for elderly customers who typically do not use cell phone apps. To minimize customer computation error, the invention employs a method in which the server enters the bill amount into the specialty computation device within the guest check presenter before presenting the guest check to the patron, consequently minimizing customer data input. Although, the customer could enter the bill amount instead.

In addition, the specialty computation device is designed in a manner to only perform task-specific calculations. These calculations are limited to gratuity computations and bill divisibility computations. To aid in the object of minimizing customer data input and therefore computation error, the only buttons incorporated into the unit's design are those which are task-specific, purposely restricting a user's ability to enter incorrect arithmetic calculations.

The second embodiment of the specialty device comprises:

i. 0-9 numerical buttons, including a decimal point button, for the server to enter the total bill amount (the buttons being real and/or virtual);

ii. one or more viewing screens; and iii. clear and enter buttons (the buttons being real and/or virtual).

The present invention also employs a unique design specifically intended to create a cost-efficient product to meet market demand. Current guest check presenters on the market that employ similar features are not cost-efficient for restaurant owners. These products are expensive and consequently deter restaurants from providing customers with such a product. It is a primary objective of the present invention to provide a design that changes this. The present invention accomplishes this by a careful and conservative selection of construction materials in accordance with an innovative design. This is accomplished by cutting out superfluous features. The specialty calculator does not include plus, minus, multiplication, or division buttons in its design. The present invention recognizes that these buttons would be unnecessary to the intended function of the device, and therefore the present invention is designed accordingly. Similarly, the magnifying plane on the unit is incorporated directly in line with the specialty calculator, rather than a standalone magnifying plane. These adaptations to the common design are important because they allow a decreased manufacturing cost, which will ultimately make the product more cost-efficient, enabling more restaurants to purchase a technologically advanced guest check presenter.

According to the second embodiment, the guest check presenter comprises:

a case having a front side and a back side;

a computation device being disposed on the case;

a magnifier being disposed on the case; and a light being disposed on the case.

Continued Summary: A guest check presenter comprising a credit card pocket, a computation device designed to output gratuity percentages and split the bill total among multi-person parties; the computation device having a real or virtual keypad, a transparent magnifying bill sleeve, and a back light.

A method for presenting and processing a restaurant bill utilizing the guest check presenter comprising the following steps:

a. a restaurant employee inputting and printing the check details;

b. the restaurant employee placing the check in the magnifying bill sleeve;

c. the restaurant employee inputting the total check amount into the numeric keypad of the computation device;

d. the restaurant employee presenting the guest check presenter to patron(s); and one or more of the following steps:

e. the patron(s) reading all or part of the check through the transparent, magnifying bill sleeve;

f. the patron(s) inputting a percentage amount of gratuity on the computation device; and/or g. the patron(s) inputting the number of people in the party among whom the check is to be divided.

The computation device can have a 15%, an 18%, and a 20%. Real or virtual gratuity key, and the method further comprises a step of a patron pressing the 15%, 18%, or 20%. gratuity key to select a percentage amount of gratuity on the computation device.

The computation device can have a real or virtual up arrow key and a real or virtual down arrow key, the method further comprises a step of a patron pressing the up arrow key and/or the down arrow key to select the number of persons to split the bill, and the computation device outputting the amount owed by each person.

The method can further comprising a step of the patron turning on the light to enhance the readability of the check.

The computing device can be comprised of:

a screen display having a bill amount section, a tip amount section, a total with tip amount section, a number of persons in party section, and a per person amount section;

a real or virtual numeric keyboard;

two or more real or virtual tip % keys displaying a tip percentage amount; and an up arrow key and a down arrow key, the up arrow key and the down arrow key being real or virtual keys.

The computing device may include that the two or more real or virtual tip % keys include three tip % keys, and one of the keys displays the tip percentage amount 15%, another one of the keys displays the tip percentage amount 18%, and the remaining key displays the tip percentage amount 20%.

The method of using the computing device may comprise:

inputting a bill amount into the computing device using the numeric keyboard, the computing device displaying the bill amount in the bill amount section of the screen display;

selecting a percentage of tip by pressing one of the two or more tip % keys, the computing device displaying the tip % amount in the tip % amount section of the screen display;

inputting the number of persons splitting the bill by pressing the up arrow key to increase the number of persons splitting the bill and/or pressing the down arrow key to decrease the number of persons splitting the bill, the computing device displaying the amount per person.

The guest check presenter may comprise:

a case having a front side and a back side;

a computation device being disposed on the case;

a magnifier being disposed on the case; and a light being disposed on the case.

The guest check presenter may further comprising at least one of the following: a holder for holding the check and/or a credit card being disposed on the case, an on-off switch for the light, and/or an on-off switch for the computation device.

A method of using the guest check presenter may comprise of the following steps:

reading all or part of the check through the magnifier; and/or inputting the amount of the check into the computation device;

inputting a percentage amount of gratuity in the computation device; and/or selecting the number of people in the party among whom the check is to be divided.

12. The method of using the guest check presenter may comprise:

inputting the amount of the check into the computation device of the guest check presenter;

presenting the guest check presenter to a user; and one or more of the following steps:

reading all or part of the check through the magnifier;

inputting a percentage amount of gratuity in the computation device; and/or selecting the number of people in the party among whom the check is to be divided.

The method of using the guest check presenter may further comprising placing the check and/or a credit card in the holder.

The computation device may be disposed on the front side of the case; the magnifier is disposed within the case such that when it is viewed from the front of the case, an item facing the back side of the case is magnified; and the light is disposed on the back of the case.

The computation device may comprise:

a real or virtual keypad including numbers 0, 1, 2, 3, 4, 5, 6, 7, 8, 9, a decimal point and a clear key;

a real or virtual enter key;

a bill display screen, tip amount display screen, total with tip display screen, split the bill display screen, and per person display screen, and a tip display screen; and two or more device state displays for indicating the mode of operation of the device.

The method of using the guest check presenter may comprise:

pressing the clear key; and one or more of the following steps:

reading all or part of the check through the magnifier; and/or inputting the amount of the check into the computation device using the numbers on the keypad;

pressing the enter key;

presenting the guest check presenter to a user;

reading all or part of the check through the magnifier; and/or inputting a percentage amount of gratuity in the computation device using the numbers on the keypad, and pressing the enter key; and/or selecting the number of people in the party among whom the check is to be divided by using the numbers on the keypad, and pressing the enter key.

The method may include wherein one of the two or more device state displays is a bill entry state display, and the method further comprises the lighting up of the bill entry state display after pressing the clear button.

The method may include wherein one of the two or more device state displays is a Tip % state display, and the method further comprises lighting up of the Tip % state display after inputting the amount of the check into the computation device and pressing the enter button.

The method may include wherein a percentage amount of gratuity is input and one of the two or more device state displays is a Split# state display, further comprising lighting up of the Split# state display after inputting the percentage amount of gratuity into the computation device and pressing the enter button.

The method may include wherein a number of people is input and one of the two or more device state displays is a Tip % state display, further comprising lighting up of the Tip % state display after inputting the number of people into the computation device and pressing the enter button. The method may include wherein one of the two or more device state displays is a Tip % state display, and another of the two or more device state displays is a Split# state display, further comprising lighting up the Tip % state display or the Split# state display, and pressing the enter button to alternatively light up the Tip % state display or the Split# state display, and wherein inputting a percentage amount of gratuity in the computation device occurs when the Tip % state display is lit, and selecting the number of people occurs when the Split# state display is lit. The method may include wherein one of the two or more device state displays is a Tip % state display, and another of the two or more device state displays is a Split# state display, further comprising pressing and holding the clear button for a predetermined amount of time to set the two or more device state displays to zero.

The guest check presenter may comprise:

a. a credit card pocket; and/or a holder for holding the check b. a computation device;

c. a magnifying device; and/or d. a light.

The method for presenting and processing a bill utilizing the guest check presenter may comprise one or more of the following steps:

a. the inputting and/or printing of the check details;

b. placing the check in position c. using the magnifying device;

d. inputting the total check amount into the numeric keypad of the computation device;

e. presenting the guest check presenter;

f. reading all or part of the check;

g. doing so through the transparent, magnifying bill sleeve;

h. inputting a percentage amount of gratuity on the computation device; and/or i. inputting the number of people in the party among whom the check is to be divided.

DETAILED DESCRIPTION OF THE DRAWINGS

An integrated example of the novel guest check presenter 1 and its components are illustrated in FIG. 1. The invention includes a slot 5 for receiving a credit card 3 and a place 17 for insertion of the bill 14. The guest check presenter can also have a place where the restaurant can display its name 11. The invention features a computation device 8 that is intended to increase the ease with which a restaurant patron may split the total of the bill among several patrons 26, or calculate a desired percentage of gratuity 18, 19, 20. The total amount of the bill can be entered into the numeric keypad 31 (which can be real or virtual) on the face of the computation device by the server prior to delivery to the restaurant patron. The total amount is then shown in display 23. The restaurant patron can then select to divide the bill among members of his/her party by indicating the number of times the bill is to be split on the numeric keypad 31. This number will appear in digital readout screen 29 on the face of the computation device 8, and the invention will compute the total that each person must pay. The restaurant patron can then compute the total gratuity by selecting from percentage amount options, either 15% 18, 18% 19, or 20% 20 of the total bill, by pressing the desired selection. (Note: Different percentages can be calculated manually or buttons for different percentages can be used.)

Figure 3:
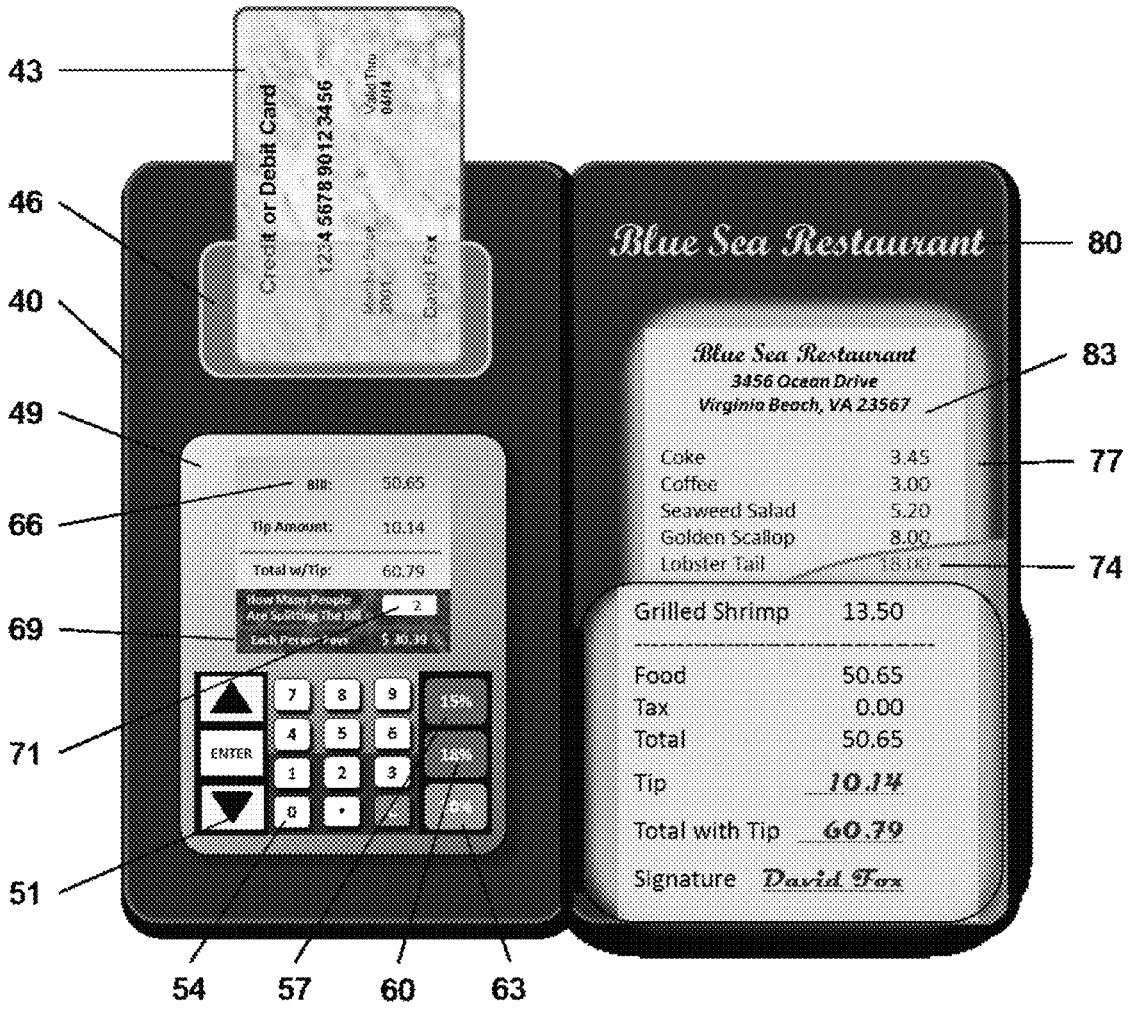
FIG. 3 is front view of a guest check presenter of the first embodiment showing the design in an open position and demonstrating the back light feature of the design as well as the magnifier.
Figure 4:
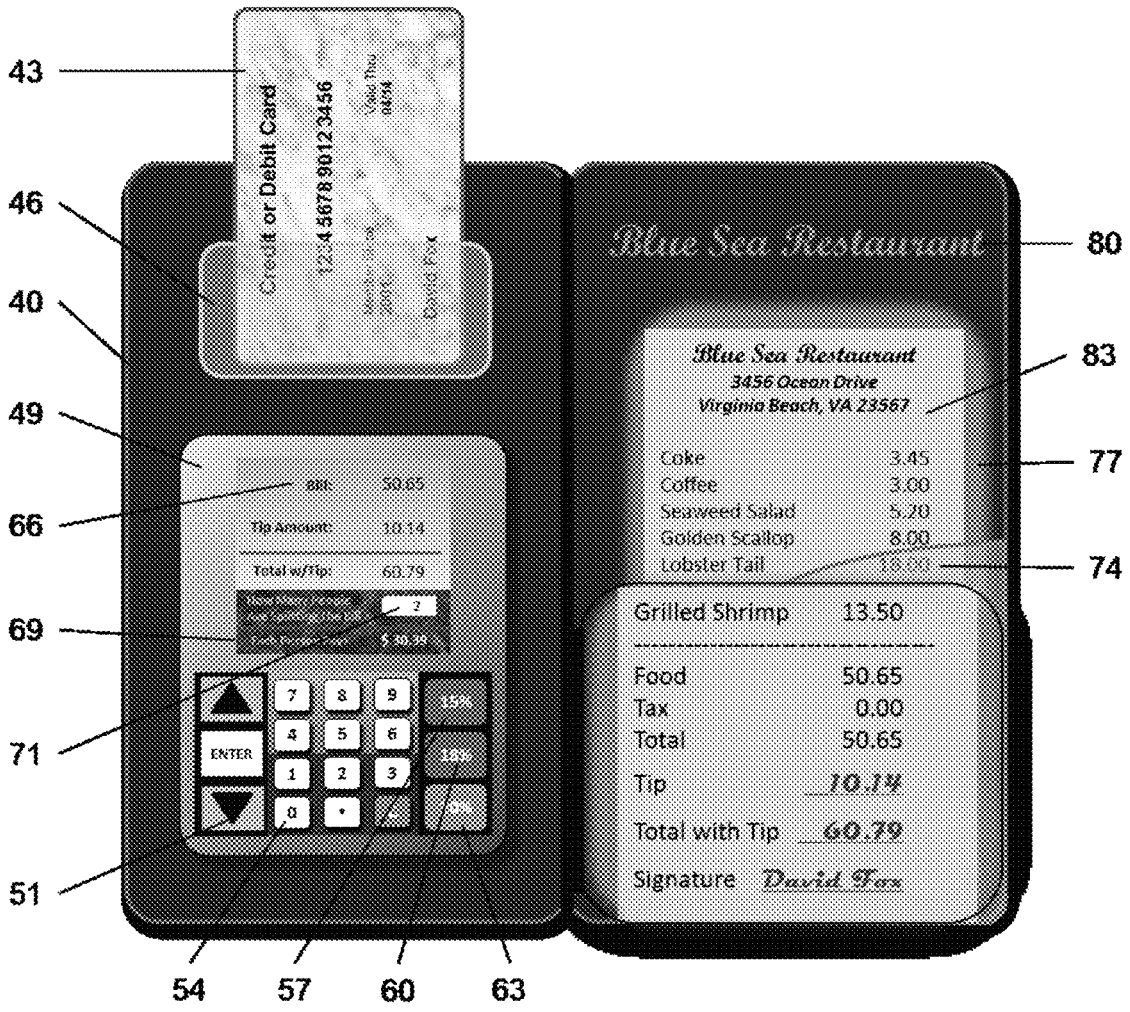
FIG. 4 is the same image as that of FIG. 3, rendered in black and white.

FIG. 3 demonstrates an embodiment of the invention that encompasses all the features of FIG. 1, but includes the additional optional features of a back light 77, and transparent bill magnifying sleeve 74 which enlarges and enhances the appearance of the entire bill. Guest check presenter 40 shown in FIG. 3 also includes credit card pocket 46, and specialty gratuity and split-party computation device 49.

Figure 5:
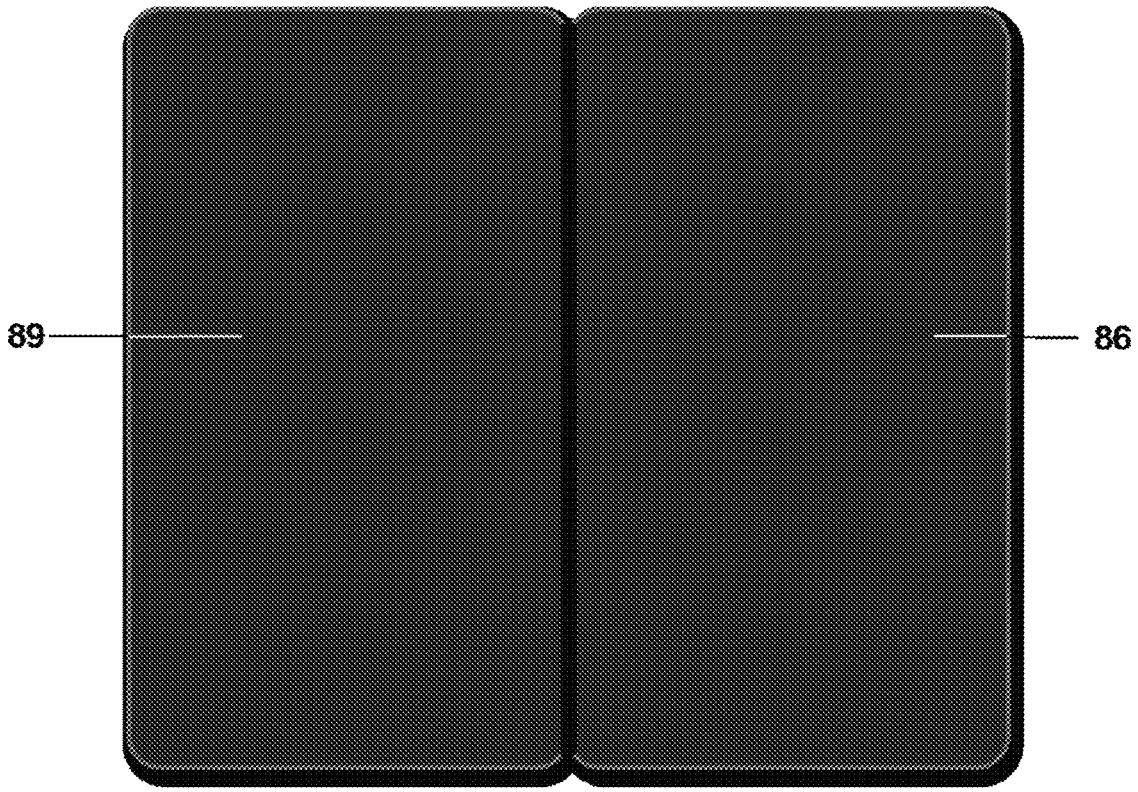
FIG. 5 is a back view of the guest check presenter of the first embodiment in an open position.
Figure 6:
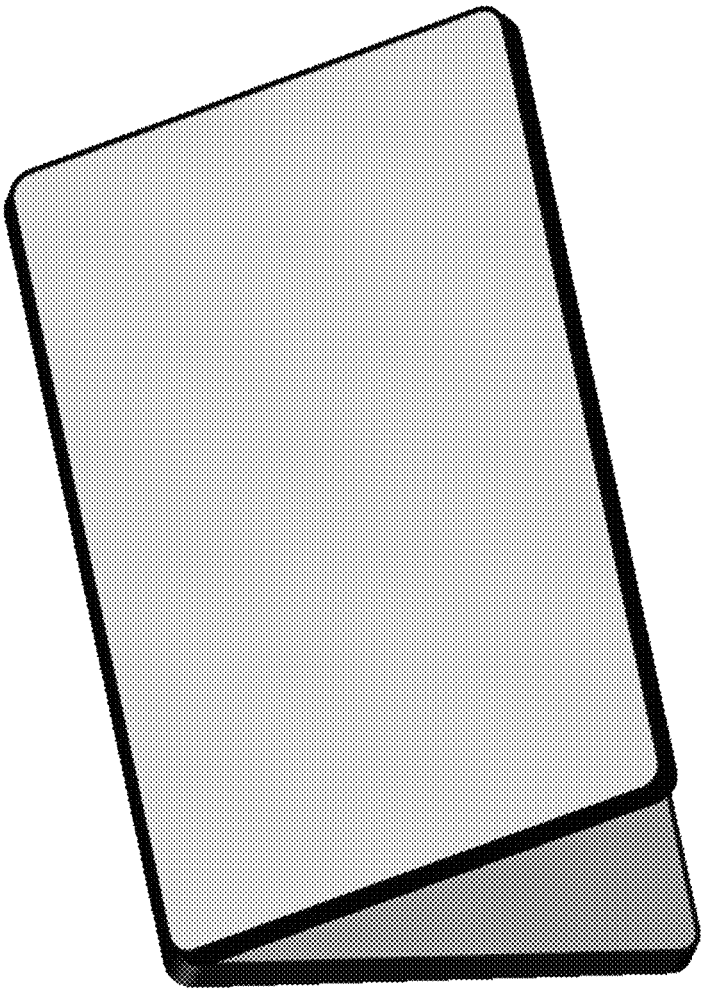
FIG. 6 is a perspective view of the guest check presenter of the first embodiment in a substantially closed position.

FIG. 5 is a back view of an example of the guest check presenter in an open position, where the inner face of left half 86 houses the calculation device and the inner face of right half 89 houses the transparent magnified bill sleeve. FIG. 6 shows an example of the guest check presenter in a substantially closed position.

Figure 7:
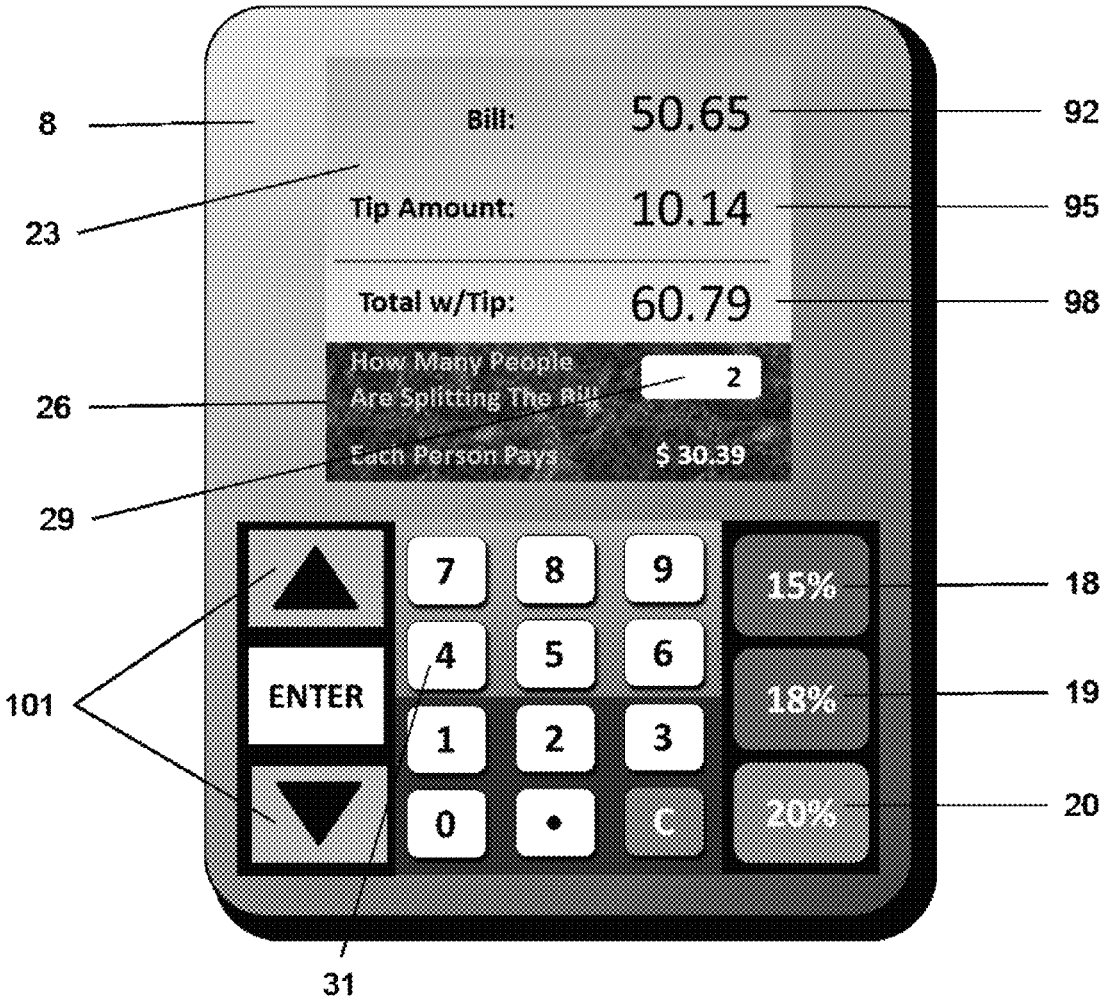
FIG. 7 is a front view of the calculation device of the first embodiment.

FIG. 7 is a close-up view of an example of the calculation device 8, where the calculation screen 23 demonstrates the functionality of the device. The bill total 92 can be seen within the screen, as well as the corresponding tip amount 95. The patron can then clearly see the total amount owed inclusive of the tip 98. Should the patron choose to split the tip among others in his/her party, he/she may do so by pressing the up or down arrows 101 located on the left-hand side of the calculation device, and see within the viewing screen 29 how many people have been selected to split the cost of the bill. The calculation device then clearly gives the total amount owed by each individual in the party 26.

Figure 8:
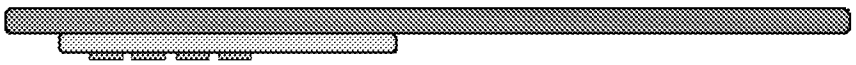
FIG. 8 is a left-side view of the left half of the guest check presenter of the first embodiment.
Figure 9:
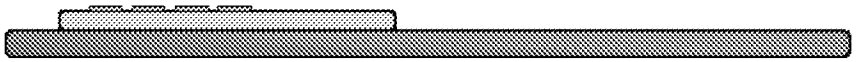
FIG. 9 is a right-side view of the left half of the guest check presenter of the first embodiment.

FIG. 8 portrays a left-side view of the left half of the guest check presenter, and FIG. 9 portrays a right-side view of the left half of the guest check presenter.

Figure 10:
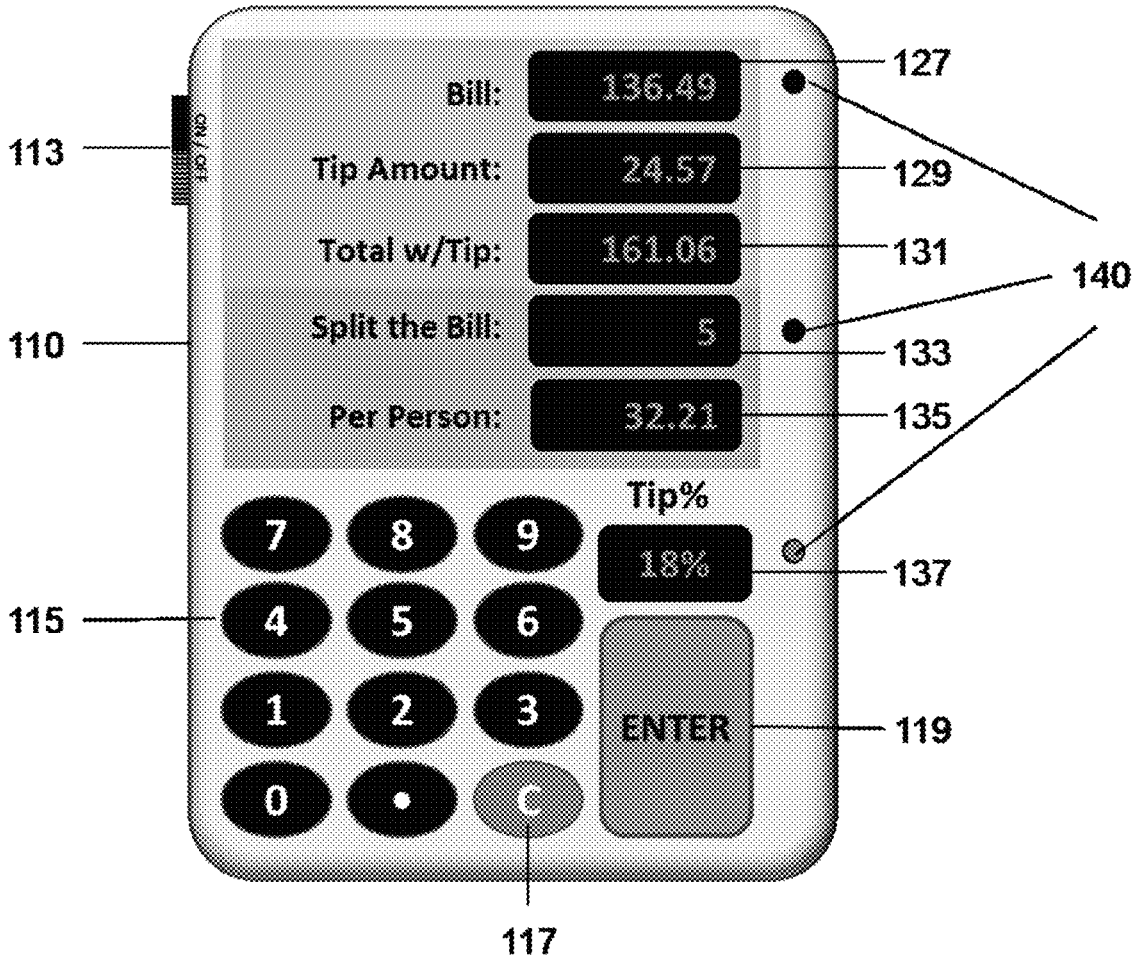
FIG. 10 is a front view of the calculation device of the second embodiment.

Another embodiment of the calculation device is shown in FIG. 10. The calculation device 110 may comprise an on/off switch 113 (in addition to a light switch, not shown), numeric and decimal point key buttons 115 (which can be real or virtual), a Clear key button (C) 117 (which can be real or virtual), and an Enter key button 119 (which can be real or virtual). It can also comprise a number of numeric display screens. FIG. 10 shows numeric display screens of the bill 127, the tip amount 129, the total amount of the bill with the tip 131, the number of persons splitting the bill 133, and the amount per person 135. The percentage amount of the tip is shown in numeric screen 137.

The calculation device 110 in FIG. 10 also includes three device state displays 140. Each device state display indicates the mode of operation of the calculation device 110 depicted in detail in FIGS. 11-16 in which any of the keys can be real or virtual.

Figure 11:
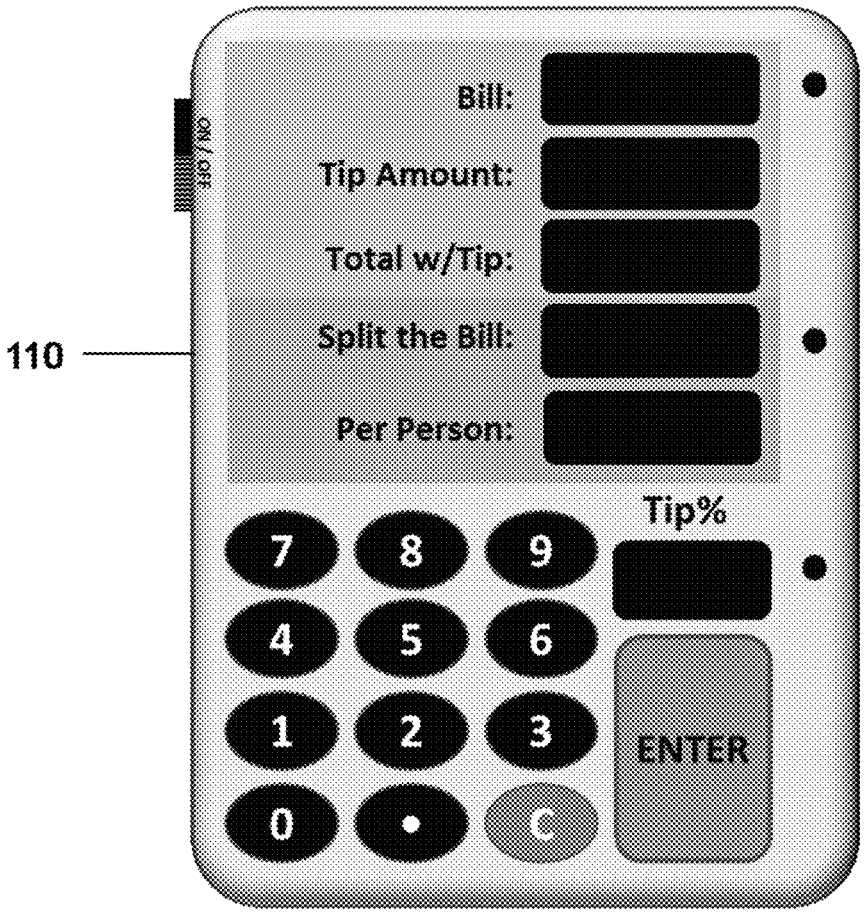
FIG. 11 is a front view of the calculation device of the second embodiment in a power off state.
Figure 12:
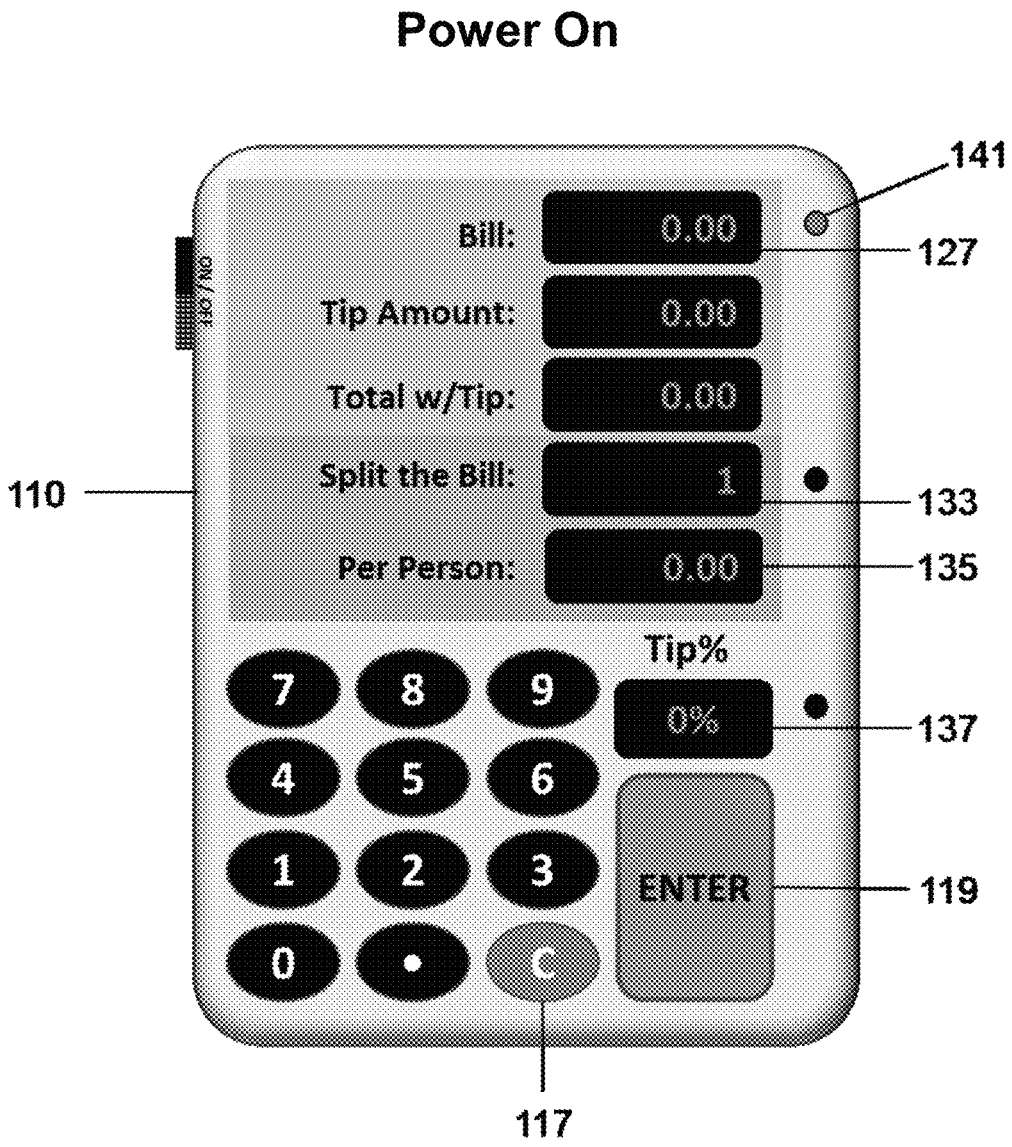
FIG. 12 is a front view of the calculation device of the second embodiment in a power on state.
Figure 13:
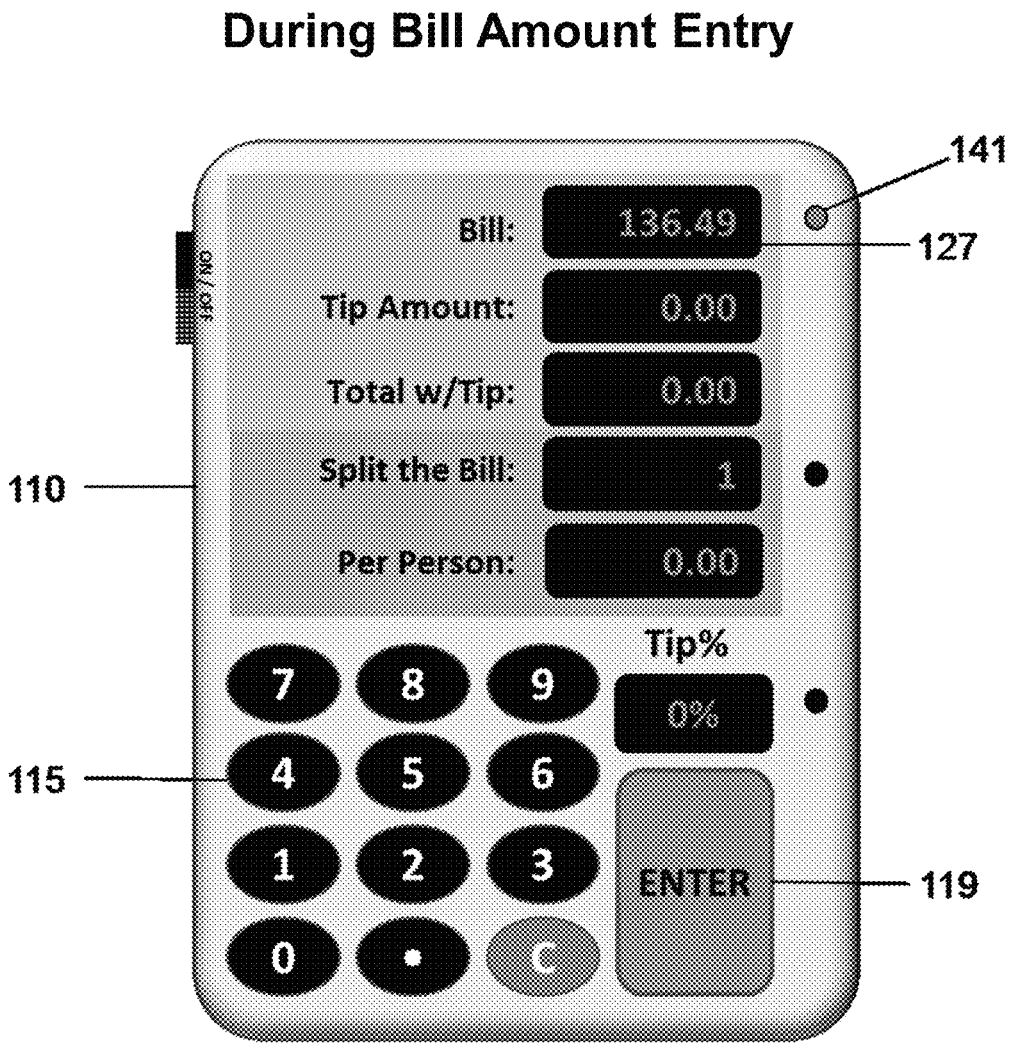
FIG. 13 is a front view of the calculation device of the second embodiment during bill entry.
Figure 14:
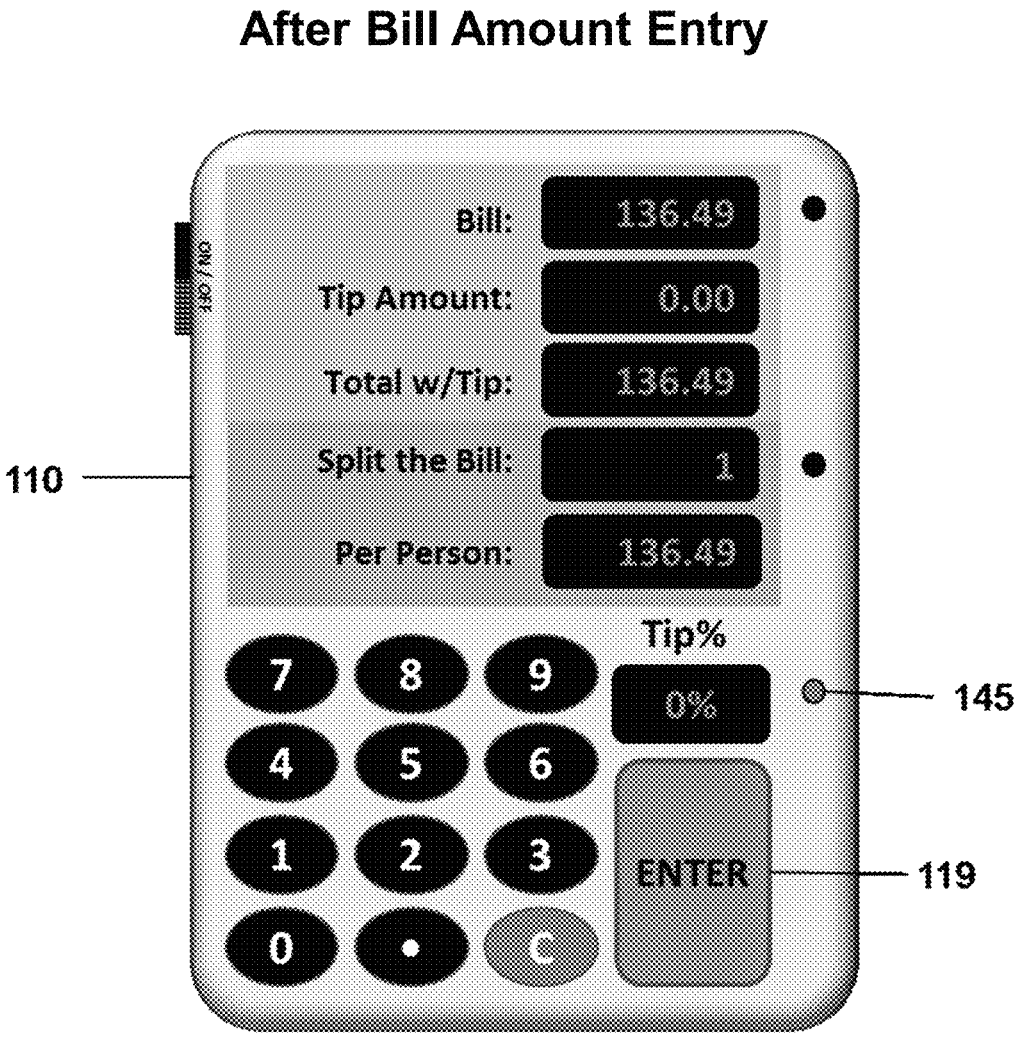
FIG. 14 is a front view of the calculation device of the second embodiment after bill entry.

The power off state shown in FIG. 11 clears all entries and turns off all displays. FIG. 12 shows the power on state with the mode of operation of the calculation device 110 being indicated by calculating device state display 141. The same mode of operation is indicated in FIG. 13 which depicts bill amount screen 127 during entry of the amount of the bill using numeric and decimal point key buttons 115. During the Bill Entry state, a user can enter a bill amount using numeric and decimal point key buttons 115 and the calculating device state display 141 is lit. Upon pressing the Enter key 119, the state transitions to the Tip % state and lights up the Tip % state display 145, as shown in FIG. 14.

Figure 15:
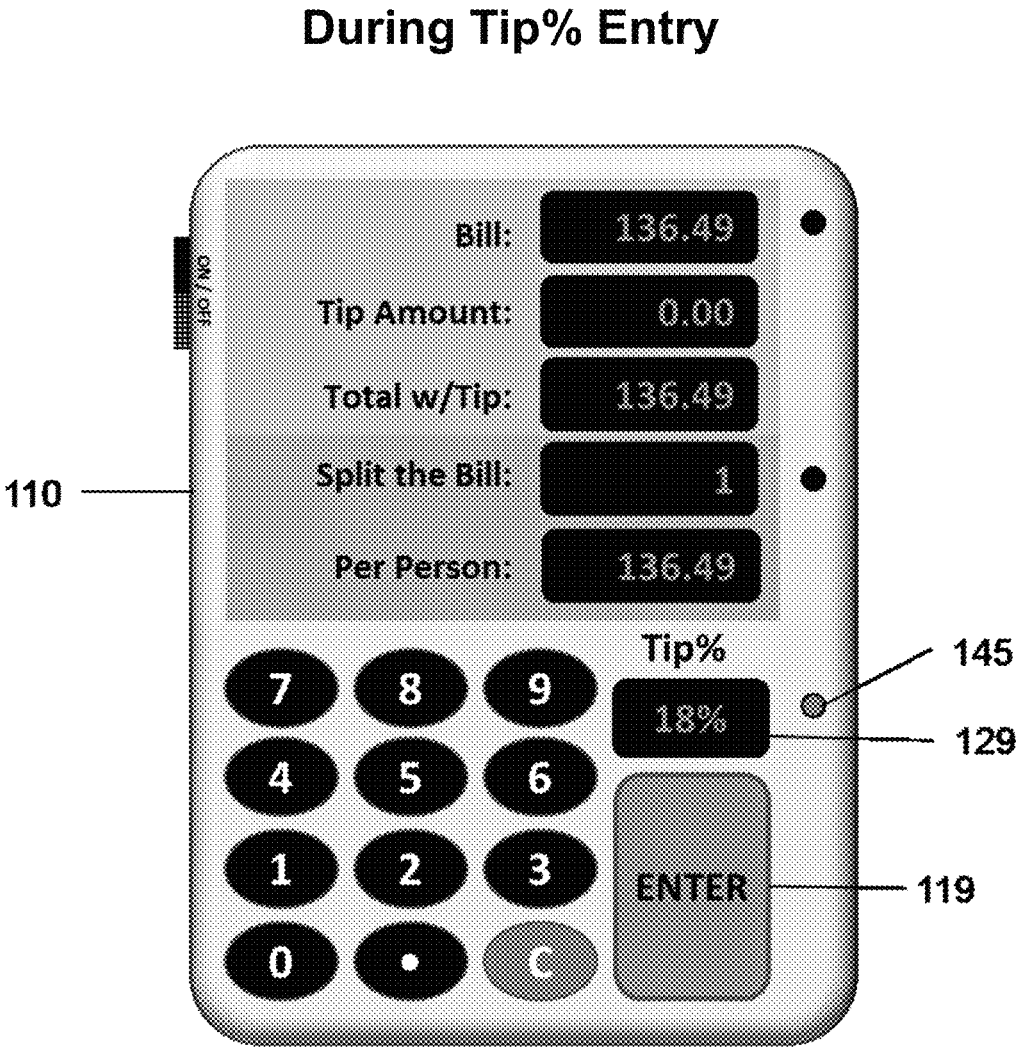
FIG. 15 is a front view of the calculation device of the second embodiment during tip % entry.
Figure 16:
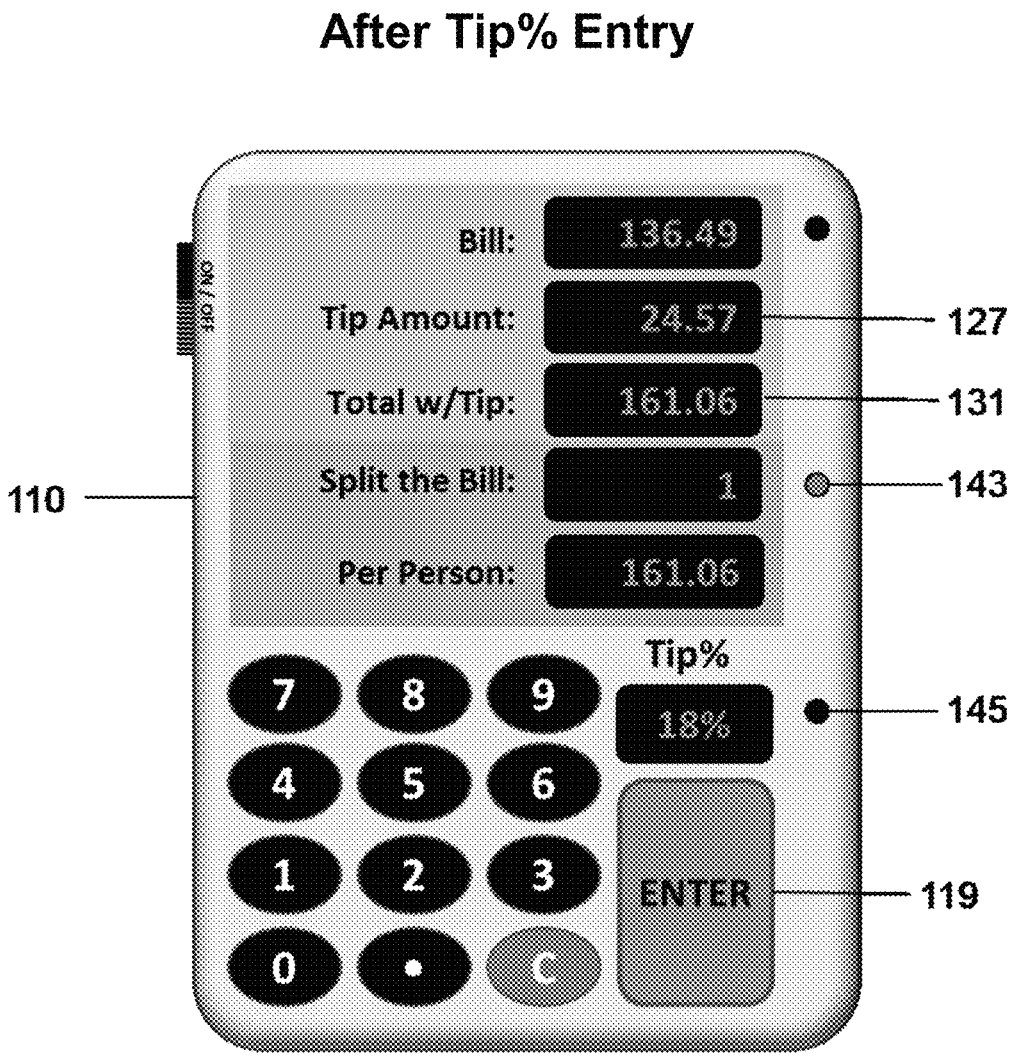
FIG. 16 is a front view of the calculation device of the second embodiment after tip % entry.

During the Tip % entry state shown in FIG. 15, the Tip % state display 145 is lit and the user can enter a percentage for the tip amount which will be shown in tip amount display screen 129. Upon pressing the Enter key 119, the calculating device 110 updates the tip amount in tip amount display screen 129 and updates the total amount with a tip 131 and also changes the calculating device state display from Tip % 145 to Split# (Split the Bill) 143, as shown in FIG. 16.

Figure 17:
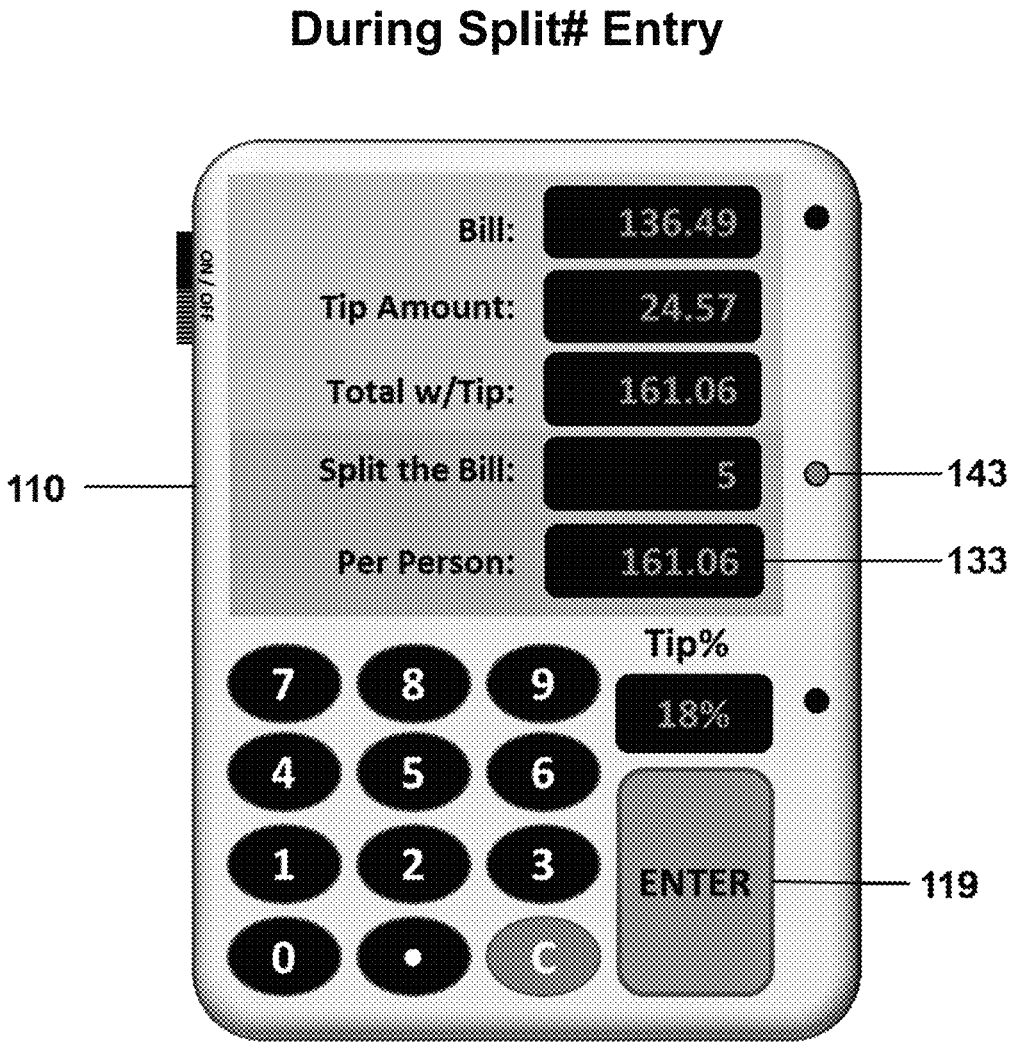
FIG. 17 is a front view of the calculation device of the second embodiment during split# entry.
Figure 18:
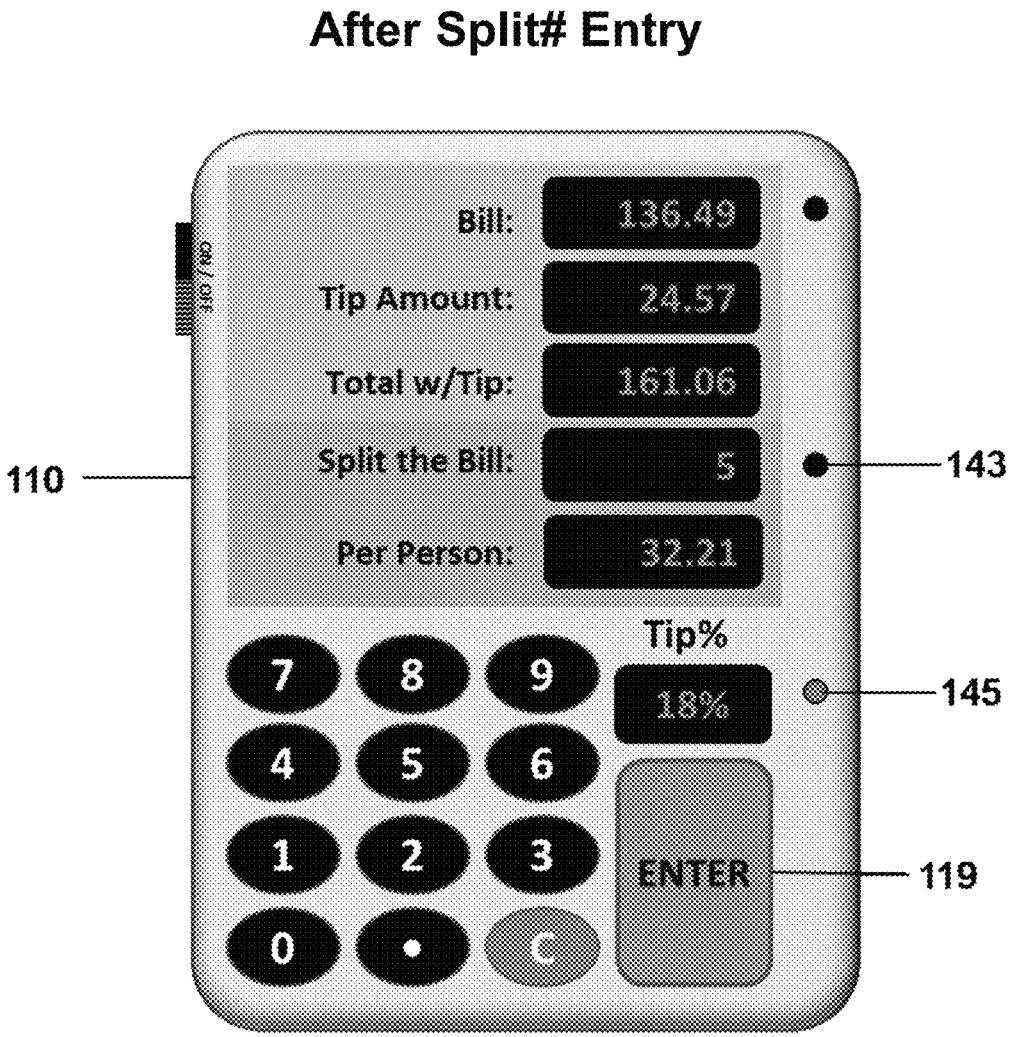
FIG. 18 is a front view of the calculation device of the second embodiment after split# entry.

During the Split# state shown in FIG. 17, the user enters a number to split the total bill, which includes the tip amount, and then the Split# is shown in screen 133. Upon pressing the Enter key 119, the calculating device 110 computes and updates the amount per person by dividing the total bill by the number of persons to split the total bill and transitions the calculating device state from Split#143 to Tip % 145, as shown in FIG. 18.

During operation, pressing the Enter key 119 successively alternates between Tip % 145 and Split#143 states to allow the user to modify entries. The Clear key 117 resets the entry for a selected state to the default screens shown in FIG. 12 (the Bill screen 127 is 0.00, the Tip % screen 137 is 0% or the Split# screen 133 is 1). All the displays are updated accordingly.

Also, holding down the Clear key 117 for a prescribed period of time resets all displays to the default screens shown in FIG. 12 (the Bill screen 127 is 0.00, the Tip % screen 137 is 0%, the Amount per Person screen 135 is 0.00, and the Split# screen 133 is 1) and returns to the Bill Entry state. This state is the same as the Power On state shown in FIG. 12. The prescribed period of time is an amount of time longer than it takes to accidentally hit Clear key 117, for example, 3-5 seconds. As an alternative, three consecutive click of Clear key 117 can be used to rest the calculating device instead of holding down the Clear key 117 for the predetermined amount of time, e.g., 3-5 seconds.

Figure 19:
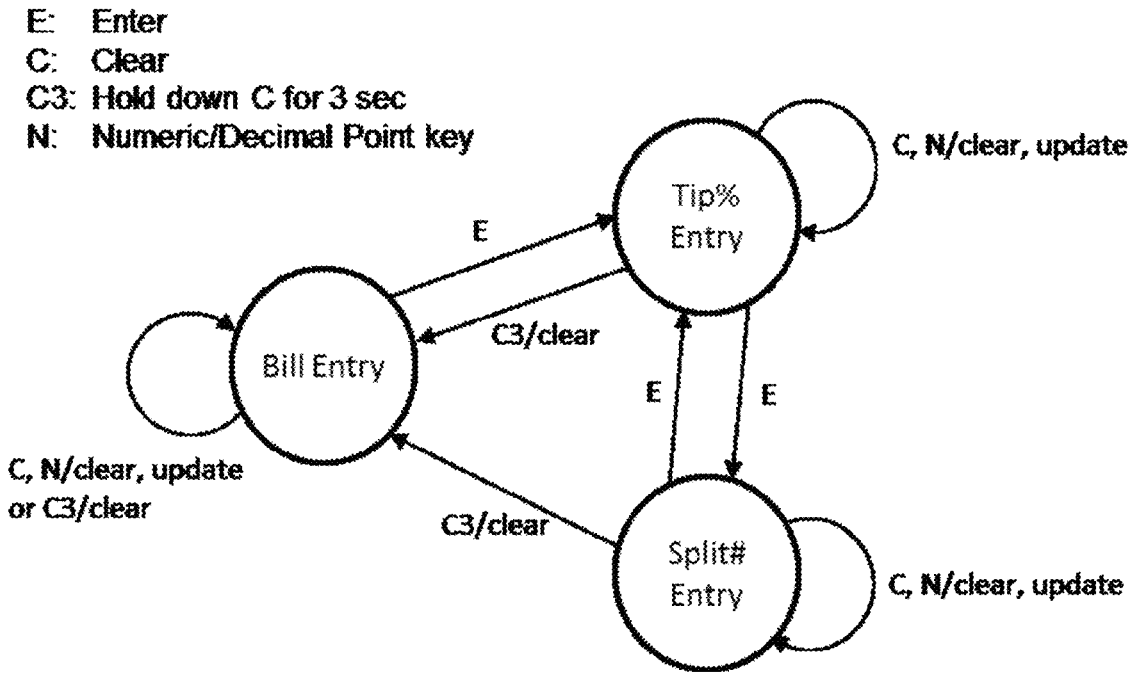
FIG. 19 is a state transition diagram for the calculation device of the second embodiment.

The calculating device can have active states for example: Bill Entry, Tip % Entry, and Split# Entry. The transition from one state to another is triggered by pressing the Clear (C) or Enter key. An exemplary state transition diagram is shown in FIG. 19.

Figure 20:
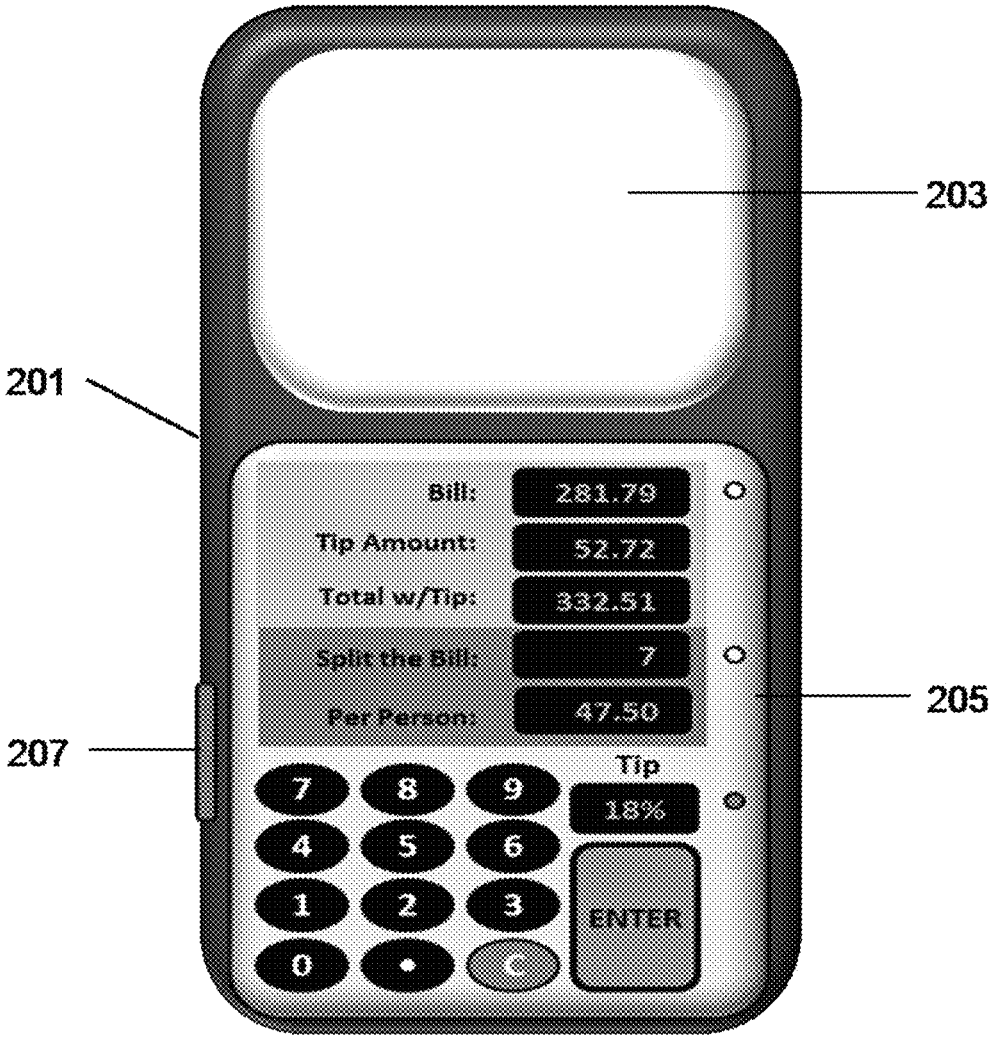
FIG. 20 is a front view of a guest check presenter device of the second embodiment.
Figure 21:
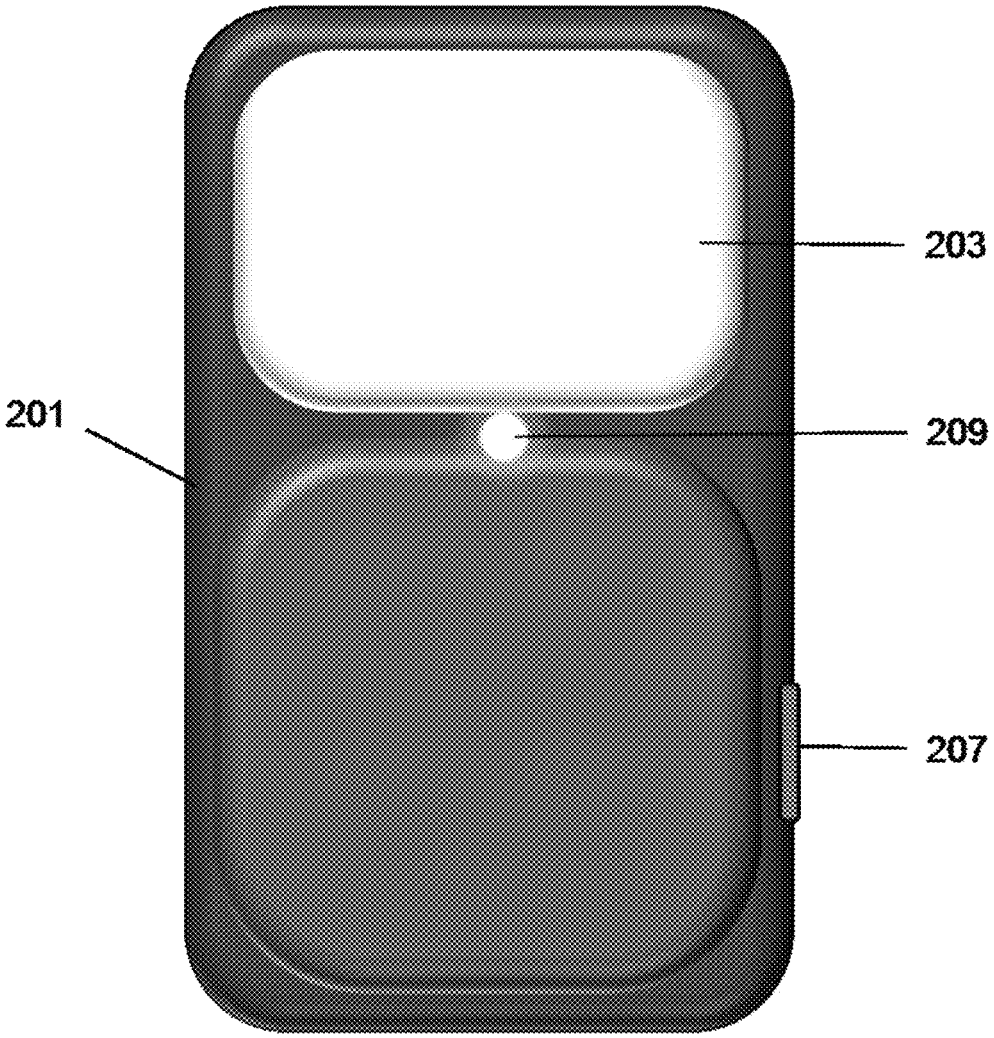
FIG. 21 is a back view of a guest check presenter device of the second embodiment.

The second embodiment of the guest check presenter of the invention is shown in FIGS. 20 and 21. A front view is shown in FIG. 20 in which the guest check presenter 201 has a magnifier 203, a calculating device 205, and an on/off switch 207. The rear view shown in FIG. 21 depicts backlight 209. The guest check presenter of the second embodiment has no limitations as to size, but some users might find it most useful when pocket-sized.

The calculating device 205 on/off switch 207 can be independent of an LED backlight on/off switch and can be turned on or turned off independently from the LED backlight switch. An alternate method of turning on or turning off the calculating device can be to hold down the "Enter" key for a predetermined time, e.g., 2, 3 or more seconds, a period of time is an amount of time longer than it takes to accidentally hit the Enter key. The calculating device on/off switch may also enable or disable lighting of all keys.

While the instant invention has been shown and described in accordance with preferred and practical embodiments thereof, it is recognized that departures from the instant disclosure are contemplated within the spirit and scope of the present invention. Therefore, the true scope of the invention should not be limited since other modifications will become apparent to those skilled in the art upon a study of the drawings, claims, descriptions, explanations, and specifications herein.

What is claimed is:

1. A guest check presenter comprising:

a housing having a front surface, a rear surface, a left side, a right side, top side and a bottom side;

a backlight located on said rear surface midway between said left side and right side and between said top side and bottom side;

a magnifying device enclosed in a fixed position within said top side of the housing, wherein when the magnifying device is viewed from the front surface of the housing, a guest check facing the rear surface of the housing is magnified through said magnifying device toward and through the front surface, and the backlight illuminates said guest check;

an on/off control for said backlight located on said left side;

a battery compartment;

at least one battery;

electronics located within said housing; and a calculation device located on said front surface and bottom side of said housing for calculating a tip and an amount of guest check due per persons of a party or group of persons comprising:

a display screen for displaying information, prices, and amounts contained in the guest check comprising a display section for a bill amount, a tip amount, a total amount with tip amount, a number of persons in party and a per person amount; and a grouping of flat style push buttons, wherein said grouping comprises a flat style push button for each of the numbers 0 through 9, a decimal point button, an enter-command button and at least one of an on/off control for said display screen button, a clear said display screen button, and a dual-function on-off and clear display screen button.

2. The guest check presenter of claim 1 further comprising a guest check holder or case that attaches to the guest check presenter.

3. The guest check presenter of claim 2 wherein said guest check holder or case comprises of at least one of a cover, a pocket, a pouch, and a sleeve.

* * * * *